US006561850B2

(12) United States Patent
Letourneau et al.

(10) Patent No.: US 6,561,850 B2
(45) Date of Patent: May 13, 2003

(54) HIGH SPEED CARD EDGE CONNECTORS

(75) Inventors: Guy Louis Letourneau, Warren, OR (US); Joseph Richard Salamone, Contoocook, NH (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 10/229,736

(22) Filed: Aug. 27, 2002

(65) Prior Publication Data

US 2003/0003804 A1 Jan. 2, 2003

Related U.S. Application Data

(63) Continuation of application No. 09/474,818, filed on Dec. 29, 1999, now Pat. No. 6,464,537.

(51) Int. Cl.[7] ..... H01R 13/648

(52) U.S. Cl. ..... 439/608; 439/637; 439/108; 439/60; 439/607

(58) Field of Search ..... 439/608, 609, 439/629–637, 61, 67, 924, 60, 607, 108

(56) References Cited

U.S. PATENT DOCUMENTS

| | | | | |
|---|---|---|---|---|
| 2,879,491 | A | 3/1959 | Shapiro | 439/62 |
| 3,173,734 | A | 3/1965 | Hartwell | 339/49 |
| 3,399,372 | A | 8/1968 | Uberbacher | 339/17 |
| 3,516,046 | A | 6/1970 | Gettig | 339/176 |
| 3,634,814 | A | 1/1972 | Inaker | 439/608 |
| 3,992,072 | A | 11/1976 | Anhalt et al. | |
| 4,067,637 | A | 1/1978 | Narozny | 339/198 |
| 4,324,451 | A | 4/1982 | Ammon et al. | 339/176 MP |
| 4,343,528 | A | 8/1982 | Lucius et al. | 339/198 G |
| 4,530,561 | A | 7/1985 | Tyree et al. | 339/134 |
| 4,550,959 | A | 11/1985 | Grabbe et al. | 339/9 E |
| 4,556,628 | A | 12/1985 | Greschner et al. | 430/314 |
| 4,586,254 | A | 5/1986 | Ammon et al. | 29/884 |
| 4,596,436 | A | 6/1986 | Kraemer et al. | 339/206 R |
| 4,674,814 | A | 6/1987 | Hoshino et al. | 439/586 |
| 4,820,169 | A | 4/1989 | Weber et al. | 439/65 |
| 4,883,432 | A | 11/1989 | Reed | 439/553 |

(List continued on next page.)

*Primary Examiner*—Tho D. Ta
*Assistant Examiner*—Larisa Tsukerman
(74) *Attorney, Agent, or Firm*—Harrington & Smith, LLP

(57) ABSTRACT

A card edge connector includes an elongated longitudinally extending outer frame defining a reception region adapted to receive a plurality of chiclet modules including contact members and lying in parallel laterally extending planes which, as an assembly, are positioned to connectively engage with mating contacts. Each chiclet module includes an insulative housing having first and second spaced generally parallel elongated passages therein and a card receiving recess for reception therein between the first and second passages of a planar card having opposed surfaces with conductive contact members thereon. First and second contacts are received, respectively, in the first and second passages. Each has a first contact surface positioned, respectively, for engagement with first and second of the mating contacts. The card receiving recesses of the chiclet modules as a group define a longitudinally extending card receiving slot. The contacts each include a second contact surface projecting into the card receiving slot for engagement, respectively, with second conductive contact members on the planar card. A tubular ground shield may be slidably received on the insulative housing in proximate engagement with its outer peripheral surface. In this instance, the ground shield includes a first integral ground contact for engagement with a ground contact of an external unit associated with the mating contacts engaged by the first contact surfaces of the first and second contacts and a second integral ground contact for engagement with a ground contact surface on the planar card inserted into the card receiving slot.

2 Claims, 13 Drawing Sheets

U.S. PATENT DOCUMENTS

| | | | | |
|---|---|---|---|---|
| 4,892,487 | A | 1/1990 | Dranchak et al. | 439/260 |
| 4,997,386 | A | 3/1991 | Kawachi et al. | 439/352 |
| 5,013,263 | A | 5/1991 | Gordon et al. | 439/630 |
| 5,024,609 | A | 6/1991 | Piorunneck | 439/637 |
| 5,057,028 | A | 10/1991 | Lemke et al. | 439/101 |
| 5,090,911 | A | 2/1992 | Welsh | 439/79 |
| 5,096,435 | A | 3/1992 | Noschese et al. | 439/260 |
| 5,104,341 | A | 4/1992 | Gilissen et al. | 439/608 |
| 5,125,854 | A | 6/1992 | Bassler et al. | 439/607 |
| 5,145,411 | A | 9/1992 | Pastal et al. | 439/598 |
| 5,169,324 | A | 12/1992 | Lemke et al. | 439/101 |
| 5,184,961 | A | 2/1993 | Ramirez et al. | 439/59 |
| 5,221,218 | A | 6/1993 | Marach | 439/637 |
| 5,228,871 | A | 7/1993 | Googman | 439/607 |
| 5,308,248 | A | 5/1994 | Davidge et al. | 439/59 |
| 5,330,371 | A | 7/1994 | Andrews | 439/579 |
| 5,336,117 | A | 8/1994 | Mizuguchi et al. | 439/717 |
| 5,443,403 | A | 8/1995 | Weidler et al. | 439/701 |
| 5,445,531 | A | 8/1995 | Billman et al. | 439/160 |
| 5,496,180 | A | 3/1996 | Fabian et al. | 439/60 |
| 5,580,257 | A | 12/1996 | Harwath | 439/108 |
| 5,584,728 | A | 12/1996 | Cheng | 439/637 |
| 5,605,476 | A | 2/1997 | MaNamara et al. | 439/608 |
| 5,618,191 | A | 4/1997 | Chokano et al. | 439/108 |
| 5,704,793 | A | 1/1998 | Stokoe et al. | 439/62 |
| 5,716,237 | A | 2/1998 | Conorich et al. | 439/660 |
| 5,785,537 | A | 7/1998 | Donahue et al. | 439/79 |
| 5,876,214 | A | 3/1999 | McHugn et al. | 439/60 |
| 5,882,214 | A | 3/1999 | Hillbish et al. | 439/79 |
| 5,924,898 | A | 7/1999 | Dutton et al. | 439/701 |
| 6,004,163 | A | 12/1999 | Behling et al. | 439/701 |
| 6,102,744 | A | 8/2000 | Korsunsky | 439/637 |
| 6,123,584 | A | 9/2000 | Van Koetsem et al. | 439/608 |

HIGH SPEED CARD EDGE CONNECTORS

CROSS-REFERENCE TO RELATED APPLICATION

This is a continuation patent application of U.S. patent application Ser. No. 09/474,818 filed Dec. 29, 1999, now U.S. Pat. No. 6,464,537.

BACKGROUND OF THE INVENTION

1. Field of the Invention

The present invention relates to modular electrical connectors and, more particularly, to card edge connectors with shielded modular inserts.

2. Discussion of Earlier Developments

There is a plethora today of known constructions of multiple contact electrical connectors providing a variety of features including some form of modular construction and signal shielding. A few of the more pertinent patented constructions known to the applicants will now be briefly described.

U.S. Pat. Nos. 4,067,637 to Narozny, No. 4,324,451 to Ammon et al. and 4,530,561 to Tyree et al. are generally descriptive of currently used card edge connectors.

U.S. Pat. No. 4,550,959 to Grabbe et al. discloses an expandable, modular card edge connector in which individual elements are unified into a longitudinal whole by melting an interfacing material between adjoining sections. Withdrawal of the heat source results in a generally rigid assembly.

U.S. Pat. No. 4,586,254 to Ammon et al. discloses a modular printed circuit card edge connector in which two end bodies engage opposite ends of a single insulator body which contains the entire population of contacts. It is intended to be manufactured in a generally long bar, or by a continuous molding process, to provide for cutting to length a single, unitary housing component containing the desired number of contact arrays.

U.S. Pat. No. 5,013,263 to Gordon et al. and U.S. Pat. No. 5,584,728, both disclose an electrical connector built up of interlocking modules. Specifically, the connector structures have conversely shaped interlocking parts at their ends to interlock end-to-end with similar structures to form a substantially self-supporting structure that can have any desired number of contacts, each spaced an integral multiple of the same unit distance from all of the contacts on all of the modules.

U.S. Pat. No. 5,104,341 to Gilissen et al. discloses an electrical connector mountable to a printed circuit board which includes a plurality of insulated housings. The housings accept a plurality of terminal subassemblies into which a plurality of electrical terminals are integrally molded. Shield members are insertable into the rear of the connector housing to shield adjacent vertical rows of terminals from cross talk.

U.S. Pat. No. 5,704,793 to Stokoe et al. discloses an electrical connector which is scalable in its engagement widths, but not by means of combinations of contact modules. The scalable components of this invention are contained within a longitudinal latching and clamping mechanism. This invention uses a single and discrete membrane such as a flex circuit, which must be clamped on to the card edge pattern by the latching and clamping mechanism.

U.S. Pat. No. 5,716,237 to Conorich et al. discloses an electrical connector which compensates from near-end cross talk at its mating section with near-end cross talk of an opposite polarity and essentially equal magnitude. Conductive plates connected to the conductors of the connector provide capacitive coupling unbalance between the adjacent pairs of conductors to produce the necessary opposite polarity, equal magnitude, near-end cross talk.

SUMMARY OF THE INVENTION

The present invention relates, generally, to a card edge connector which includes an elongated longitudinally extending outer frame defining a reception region. The electrical connector is adapted to receive a plurality of chiclet modules including contact members lying in parallel laterally extending planes which, as an assembly, are positioned to connectively engage with mating contacts. Each chiclet module includes an insulative housing having first and second spaced generally parallel elongated passages therein and a card receiving recess for reception therein between the first and second passages of a planar card having opposed surfaces with conductive contact members thereon. First and second elongated contacts are firmly received, respectively, in the first and second passages. Each has a first contact surface positioned, respectively, for engagement with first and second of the mating contacts. The card receiving recesses of the chiclet modules as a group define a longitudinally extending card receiving slot. The elongated contacts each include a second contact surface projecting into the card receiving slot for engagement, respectively, with second conductive contact members on the planar card. A tubular ground shield may be slidably received on the insulative housing in proximate engagement with its outer peripheral surface. In this instance, the ground shield includes a first integral ground contact for engagement with a ground contact of an external unit associated with the mating contacts engaged by the first contact surfaces of the first and second elongated contacts and a second integral ground contact for engagement with a ground contact surface on the planar card inserted into the card receiving slot.

A chiclet module may be described as a pre-assembled module which includes one or more contacts, an insulator, and one or more shields. The pre-assembly of identical modules creates an advantageous economy of scale. Modular chiclet designs can be easily built or altered to afford interconnection of the exact number of contacts desired, relieving the user of having to select an oversized connector.

Each chiclet module can independently mate to a designated pattern of pads positioned along a substrate edge. The substrate may be either a printed circuit card or any other embodiment of contacts residing along an edge of a thin insulator membrane or flat plane. One or more series of chiclet modules may be held in specific alignment by means of their emplacement in groups, gangs, or arrays residing in an overall plastic or metal frame.

Alignment for mating a stacked series of chiclet assemblies with a series of known target objects, such as a 2-dimensional contact pad pattern, normally presents a challenge of tolerance stack-up of the individual assemblies; the positional error of the last assembly in a series is perturbed by the sum, or accumulated tolerances, of all of the elements between it and the known position of a datum or reference object such as an alignment structure. The present invention advantageously eliminates accumulated tolerance by providing positioning structures in the overall frame for each chiclet module.

The present invention entails an insulator chiclet module whose interior contacts are shielded to the maximum extent by one or more generally box-shaped or tube-shaped shields enveloping as completely as possible the plastic insulator and its internal contacts. These shields comprise a part of the chiclet module subassembly proper, and no other insulating, shielding, or grounding structures are required in the overall frame. Manufacture of the shields into their closed or nearly closed perimeter cross sections may proceed from seamless or extruded tubes or from flat sheet stock folded into box-like or tube-like structures. A single shield may envelop the entire insulator structure and the contacts contained within, or an insulator may be provided with two or more contact-isolating lobes and a set of shields of which envelop individual lobes as completely as possible. In this card edge embodiment, the insulator is bilaterally symmetrical about the midplane of the card it admits, and this insulator accepts two box-like shields, one on each side of the card midplane. The shields include their own contacts members, and either these or their designated pads on the card edges, or both, may be specially elongated or positioned so as to establish, in a pre-emptive manner, shielding or common electrical grounding across the contact interface, in advance of electrical interconnection of other sensitive signal lines.

In some cases, mutual electrical contact between the shields of neighboring contacts is preferred, and the invention provides for chiclet modules with spring tabs or fingers which contact neighboring chiclet modules. In cases where individual electrical potentials of neighboring shields are to be maintained separate, these neighboring contacts may be eliminated, or an insulating structure may be provided in the overall frame to interpose or defeat this shield-to-shield interconnection.

The chiclet modules of the invention are designed to provide electrical contact preferably to both sides of the engaged or inserted substrate, card, or membrane edge. Single-sided deployments are also within the scope of the invention.

The inventive device may engage pad patterns of uniform spacing or pitch, or of a repeated or a staggered series of non-uniform patterns, as is common with contact arrays of shielded differential signal pairs. Individual chiclet modules, including those which span several units of pad pattern pitch, may be provided which engage with locally unique patterns. An example of this case would be an assembled connector comprising a first series of shielded differential pair units with repeated patterns of contacts on a first pitch, a second series of non-shielded modules each of which present a gang of conventional contact pairs on a second pitch, and a third series of high current power modules comprising heavy-duty contacts on a third pitch.

Thus is described an assembly containing sub-assemblies of unspecified numbers of identical shielded, modular units, which may be interspersed with non-shielded units of lower cost and also special-purpose units such as those designed for high current interconnections. The invention provides an overall frame to precisely position these modules with no accumulated tolerance stack-up. Unit members of the pattern of positioning structures provided in the frame may individually accept modules of a unitary design, or as a group may accept larger modules spanning several of these positioning structures. If desired, one or more positions in this frame may be left empty, or a blank or dummy module may be provided. The pitches and patterns of the contacts residing within these modules are neither necessarily equal to nor necessarily related to the pitch and pattern of the positioning structures in the overall frame.

Simple card-edge connectors rely on one or both end walls of the connector to align it with the pad patterns residing on the card. It is also known that one or more intermediate notches may be provided along a card edge for polarity, identification, and for improved registration of the connector to the pad patterns on the card by means of including a plenum or stub in the connector which registers in the slot(s) under proper insertion. While it is possible to provide special-purpose chiclet modules each of which include local registration features, the cost of producing a series of complimentary mating features along the card edge is likely to prohibit this approach. Therefore, our invention preferably provides a primary alignment plenum or stub or a primary set of these, incorporated in the overall frame in a manner which defines a precise positional relationship between this alignment feature or feature set, and the series of positioning structures within the overall frame which align the chiclet module sets. These primary features in the overall frame provide initial and precise alignment of the chiclet modules to their associated patterns on the card edge, by means of the chiclet modules being engaged and registered by the series of positioning structures in the overall frame and by virtue of the fact that both the positioning structures and the primary alignment features are integral features of the overall frame. Therefore, the locational accuracy of the chiclet modules with respect to an alignment slot provided in the card edge (complimentary to the primary alignment feature of the frame) accrues no accumulated tolerances associated with the number, type, or distance from the frame's primary alignment features to its positioning structures which locate the chiclet modules. By this arrangement, the locational accuracy of any particular chiclet module is limited only by the accuracy and reliability of the process used to provide the features of the overall frame.

While conventional housings designed to receive a series of modules often provide an individual aperture or receiving section for each individual module or insert, our overall frame provides one or a small series of large longitudinal openings each of which may accept our chiclet modules in groups. The positioning structures mentioned elsewhere reside nearby and extend within the general openings. Our chiclet modules are designed with complimentary features to accept precise alignment by these positioning features in the frame. According to the preferred embodiment, these features are common to all types of chiclet modules and all openings in the frame, which affords a maximum diversity of the combinations and compositions of groups of chiclet modules available for assembly into the overall frame. However, it is understood that sets of frames and chiclet modules may be designed with distinct families of positioning structures and features, whereby these frames, in offering a first set of positioning structures in any one aperture and a mechanically incompatible second and distinct series of positioning structures in any other aperture will prevent the mingling of one family of chiclet module designs with a second family of designs within the same aperture. This segregation may be advantageous as a polarity feature, or as a means of eliminating assembly operator error, or to provide a special and proprietary series of product distinct from a general commodity design. An additional advantage of such segregation is the separation and deliberate location of a distinct series of chiclet modules of an especially robust design capable of withstanding severe service, such as high voltages, high currents, or exceptional mating life demands, whose special positioning structures are mechanically incompatible with elements from the series of standard service designs. In this case, such segregation can advantageously prevent an undesirable or dangerous condition, including the untimely or catastrophic failure of an improperly positioned standard service unit or chiclet module group accidentally subjected to severe service.

Where a continuous wall or perimeter structure would occlude visual inspection of good manufacturing processes, such as successful solder reflow of surface mount contacts, or full and complete insertion of chiclet modules into the overall frame, the frame is preferably provided with apertures, or continuous longitudinal cut-away sections, or a pattern of cut-out profiles (e.g., perforated, invected, embattled, engrailed, etc.) affording such visual inspection by completely or intermittently revealing internal features, component positions, or the results of operations otherwise enclosed by the overall frame.

A primary feature, then, of the present invention is the provision of a modular electrical connector.

Another feature of the present invention is the provision of such a modular electrical connector in the form of a card edge connector with shielded modular inserts.

Still another feature of the present invention is the provision of such a modular connector including an elongated longitudinally extending outer frame defining a reception region adapted to receive a plurality of chiclet modules including contact members and lying in parallel laterally extending planes which, as an assembly, are positioned to connectively engage with mating contacts.

Yet another feature of the present invention is the provision of such a modular connector wherein each chiclet module includes an insulative housing having first and second spaced generally parallel elongated passages therein and a card receiving recess for reception therein between the first and second passages of a planar card having opposed surfaces with conductive contact members thereon, a first elongated contact firmly received in the first passage having a first contact surface positioned for engagement with a first of the mating contacts, a second elongated contact firmly received in the second passage having a first contact surface positioned for engagement with a second of the mating contacts, wherein the card receiving recesses of the plurality of chiclet modules as a group defines a longitudinally extending card receiving slot, the first elongated contact including a second contact surface projecting into the card receiving slot for engagement with a first conductive contact member on the planar card inserted into the card receiving slot and the second elongated contact including a second contact surface projecting into the card receiving slot in the direction of the first elongated contact for engagement with a second conductive contact member on the planar card inserted into the card receiving slot.

Still a further feature of the present invention is the provision of such a modular connector wherein a tubular ground shield is slidably received on the insulative housing in proximate engagement with its outer peripheral surface, the ground shield including a first integral ground contact for engagement with a ground contact of an external unit associated with the mating contacts engaged by the first contact surfaces of the first and second elongated contacts and a second integral ground contact for engagement with a ground contact surface on the planar card inserted into the card receiving slot.

Still another feature of the present invention is the provision of such a modular connector including first and second ground shields, each having a C-shaped cross section, slidably received, respectively, on the insulative housing in opposed relationship and in proximate engagement with its outer peripheral surface, the first ground shield generally overlying the first elongated passage, the second ground shield generally overlying the second elongated passage, the first ground shield having first and second opposed limbs proximately overlying the first and second major sides, respectively, a first side limb proximately overlying the first minor side, and a first flange limb extending transverse of the first opposed limb slidably received in the first elongated slot whereby the first ground shield substantially completely surrounds the first elongated contact received in the first passage, the second ground shield having third and fourth opposed limbs proximately overlying the third and fourth major sides, respectively, a second side limb proximately overlying the second minor side, and a second flange limb extending transverse of the third opposed limb slidably received in the first elongated slot whereby the second ground shield substantially completely surrounds the second elongated contact received in the second passage, the first and second ground shields both including a first integral ground contact for engagement with a ground contact of an external unit associated with the mating contacts engaged by the first contact surfaces of the first and second elongated contacts, each of the first and second ground shields including a second integral ground contact for engagement with an associated ground contact surface on the planar card inserted into the card receiving slot.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
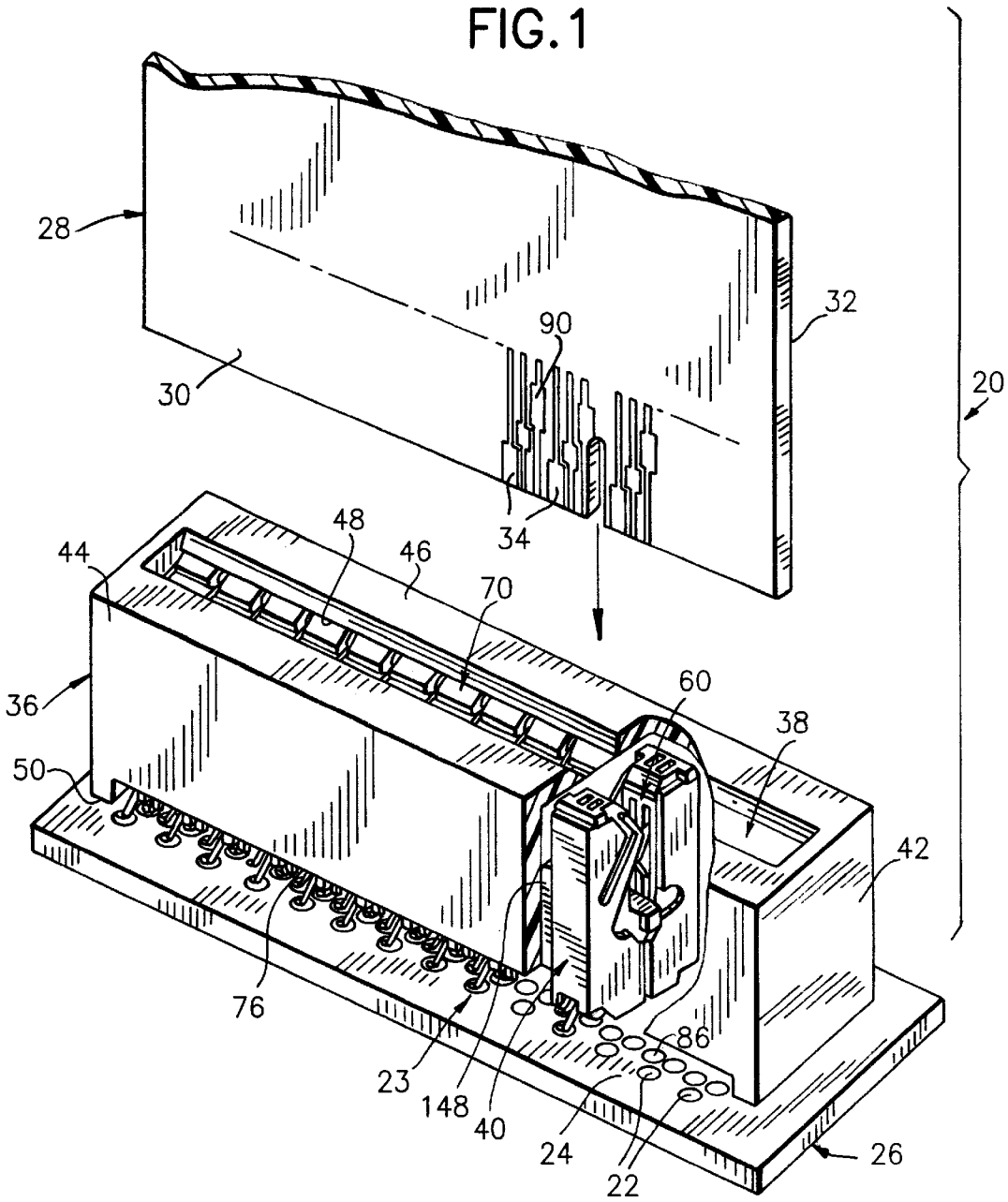
FIG. 1 is an exploded perspective view of a card edge connector assembly embodying the present invention.

Referring to FIG. 1, there is shown an exploded perspective view of a card edge connector assembly 20 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The card edge connector assembly 20 includes a plurality of contact pads 22 arranged in a contact pattern 23 on an underlying contact surface 24 in the form of a motherboard 26, for example. A planar card 28, a daughter board, for example, has first and second opposed surfaces 30, 32 with conductive contact members 34 on at least one of the opposed surfaces.

Viewing now also FIGS. 2–5, an elongated longitudinally extending outer frame 36 defines a reception region 38 which is adapted to receive a plurality of chiclet modules 40. Each of the chiclet modules 40 includes contact members (to be described below) and the chiclet modules lie side by side in parallel laterally extending planes which, as an assembly, are positioned to connectively engage with the mating contact pads 22 on the underlying contact surface 24. The outer frame 36 includes opposed spaced end walls 42, opposed spaced side walls 44, and a top wall 46 integrally joining the end walls and the side walls. The end walls, side walls, and top wall together define the reception region 38, the top wall having a longitudinally extending aperture 48. The end walls 42 and the side walls 44 extend to a lower rim 50 distant from the top wall 46 and define, interiorly, an opening 52 through which the chiclet modules are inserted into the reception region 38.

Turning now to FIGS. 6, 7, and 8A–8D, each chiclet module 40 includes an insulative housing 54 which has first and second spaced generally parallel elongated passages 56, 58 therein and a card receiving recess 60 for reception of the planar card 28 (FIG. 1) between the first and second passages. A first elongated contact 62 is firmly received in a known manner in the first passage 56 and has a first contact surface 64 positioned for engagement with an associated contact pad 22 (FIG. 1) on the contact pattern 23 of the underlying contact surface 24 using known techniques. In a similar fashion, a second elongated contact 66 is firmly received in the second passage 58 having a first contact surface 68 positioned for engagement with another associated contact pad 22 on the contact pattern 23 of the underlying contact surface 24. Although shown as being surface mount contacts, any type of termination (e.g. press-fit, pin-in-paste) could be used.

As seen in FIG. 1, the card receiving recesses 60 of the plurality of chiclet modules 40 integrated as a group within the outer frame 36 define a longitudinally extending card receiving slot 70. Turning back to FIG. 6, the first elongated contact 62 includes a second contact surface 72 projecting into the card receiving slot 70 (or recess 60 of an individual chiclet module 40). The second contact surface 72 engages with an associated conductive contact member 34 on the first surface 30 of the planar card 28 inserted into the card receiving slot. In a similar fashion, the second elongated contact 66 includes a second contact surface 74 projecting into the card receiving slot 70 (or recess 60 of an individual chiclet module 40) in the direction of the first elongated contact 62. This time, the second contact surface 74 engages with a second one of the conductive contact members 34, this one being on the second surface 32 of the planar card 28 inserted into the card receiving slot.

With continued attention to FIG. 1, the lower rim 50 of the outer frame 36 includes a cutout region 76 enabling visual inspection of the first contact surfaces 64, 68 of the first and second elongated contacts 62, 66 when engaged with their associated contact pads, respectively. Also, aperture 48 of the outer frame 36 is aligned with the card receiving slot 70 when the plurality of chiclet modules are received in the reception region 38.

Figure 9:
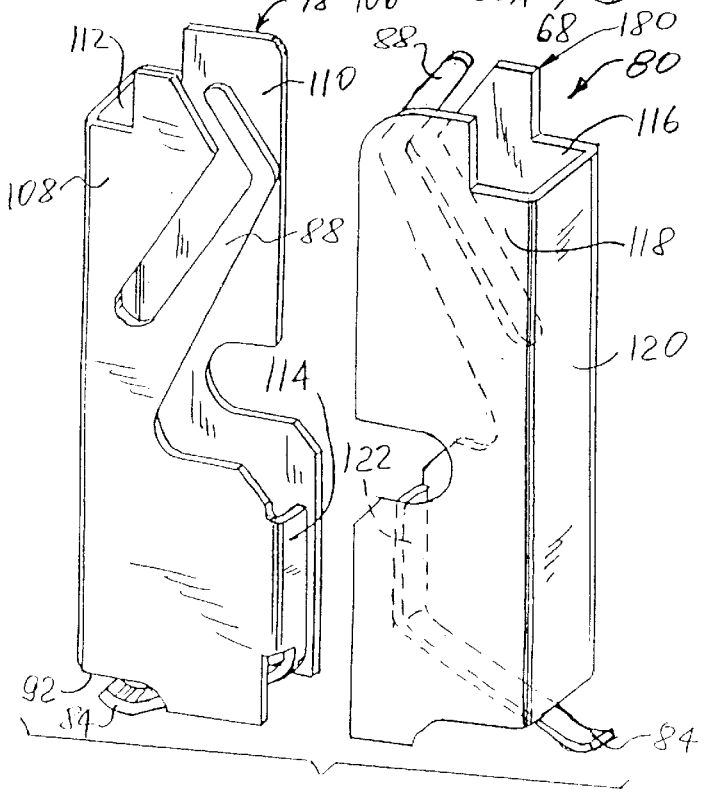
FIG. 9 is a perspective view illustrating opposed ground shields, each having a C-shaped cross section for slidable reception, respectively, on an outer peripheral surface of the insulative housing of FIGS. 6, 7, 8A, 8B, 8C, and 8D.
Figure 10:
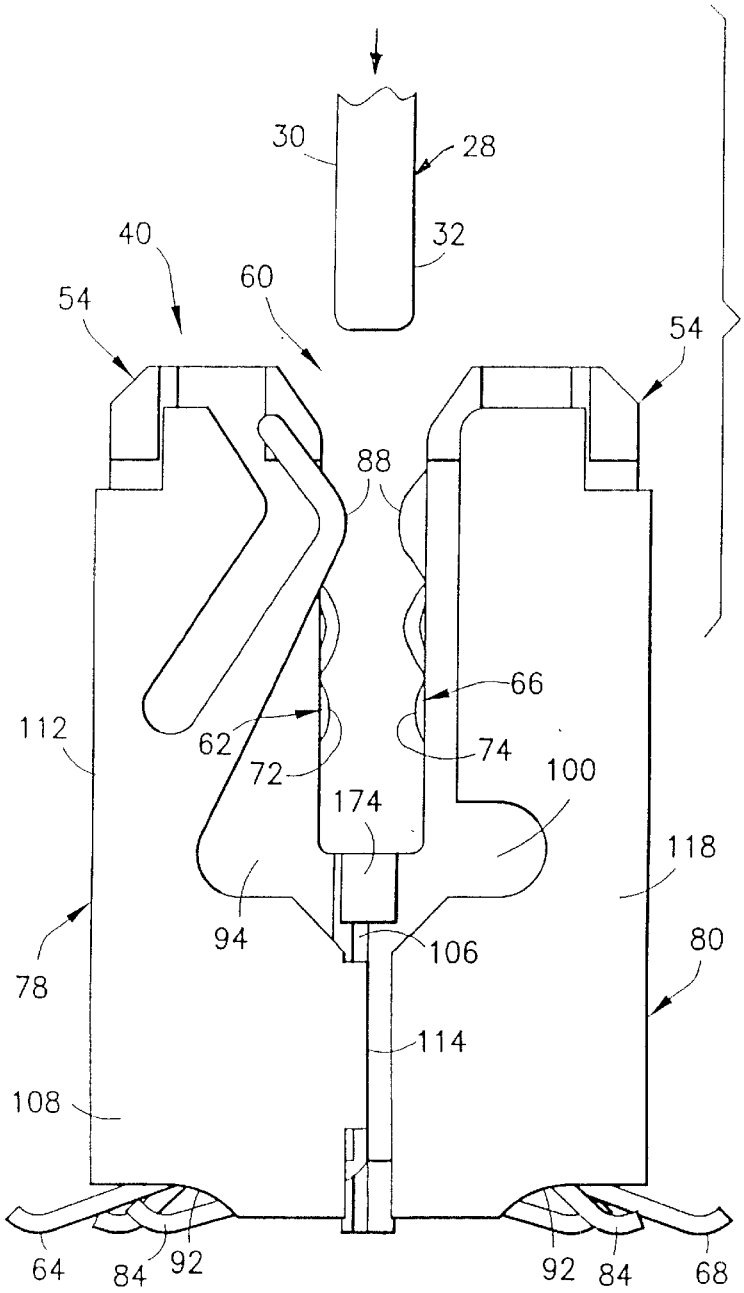
FIG. 10 is a front elevation view of a chiclet module into which a planar card such as a daughter board is about to be inserted.
Figure 11:
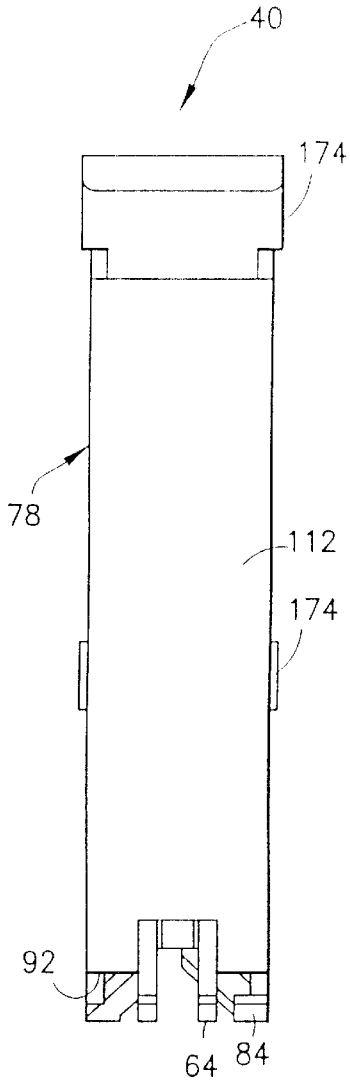
FIG. 11 is a side elevation view of the chiclet module illustrated in FIG. 10

Turn now to FIGS. 9, 10, and 11 which illustrate opposed ground shields 78, 80, each having a C-shaped cross section for slidable reception, respectively, on an outer peripheral surface 82 of the insulative housing. When so received on the insulative housing, the ground shields 78, 80 are positioned in opposed relationship and in proximate engagement with the outer peripheral surface 82. The first ground shield 78 generally overlies the first elongated passage 56 and the second ground shield 80 generally overlies the second elongated passage 58. The ground shields 78, 80 both include a first integral ground contact 84 for engagement (FIG. 1) with an associated ground contact or pad 86 of an external unit such as the mother board 26. In turn, the ground contact or pad 86 is associated with the mating contact pads 22 engaged by the first contact surfaces 64, 68 of the first and second elongated contacts 62, 66. Further, each of the ground shields 78, 80 includes a second integral ground contact 88 for engagement with an associated ground contact surface 90 on the planar card 28 inserted into the card receiving slot 70. As seen especially well in FIGS. 9, 10, and 11, each of the ground shields 78, 80 has a cutout region 92. The cutout region 92 enables visual inspection of the first contact surfaces 64, 68 of the first and second elongated contacts 62, 66 when engaged with their associated mating contact pads 22, respectively, and of the first and second ground contacts 84 when engaged with their respective mating ground contact pads 86 of the external unit or motherboard 26.

Viewing especially FIGS. 8A, 8B, 8C, and 8D, the outer peripheral surface 82 of the insulative housing 54 has first and second opposed major sides 94, 96, respectively, and a first minor side 98 joining the first and second major sides. In a similar manner, the outer peripheral surface 82 of the insulative housing 54 has third and fourth opposed major sides 100, 102 and a second minor side 104 joining the first and second major sides. The first and third major sides 94, 100 are coplanar and the second and fourth major sides 96, 102 are coplanar. By the same token, the first and second minor sides 98, 104 lie in parallel spaced apart planes. The insulative frame 54 also has a first elongated slot 106 spaced from and aligned with the card receiving recess 60 and having an inlet positioned intermediate the first and third major sides, 94, 100. The first elongated slot 106 is generally parallel with the first and second minor sides 98, 104. The insulative frame 54 also has a second elongated slot 107, also spaced from and aligned with the card receiving recess 60 and having an inlet positioned intermediate the second and fourth major sides 96, 102, respectively. The second elongated slot 107 is generally parallel with the first and second minor sides 98, 104 and coplanar with the first elongated slot 106.

A complete chiclet module 40 includes, as earlier described in a more general description, the first and second ground shields 78, 80, and these will now be described more completely as they are mounted on the insulative housing 54. Each ground shield 78, 80 has a C-shaped cross section and has earlier been described as being slidably received on the insulative housing in opposed relationship and in proximate engagement with the outer peripheral surface 82. The first ground shield 78 generally overlies the first elongated passage 56 and the second ground shield 80 generally overlies the second elongated passage 58. The first ground shield 78 has first and second opposed limbs 108, 110 proximately overlying the first and second major sides 94, 96, respectively, and a first side limb 112 proximately overlies the first minor side 98. A first flange limb 114 extends transverse of the first opposed limb 108 and is slidably received in the first elongated slot 106. With this construction, the first ground shield 78 substantially completely surrounds the first elongated contact 62 received in the first elongated passage 58.

In a similar manner, the second ground shield 80 has third and fourth opposed limbs 116, 118 proximately overlying the third and fourth major sides 100, 102, respectively. A second side limb 120 proximately overlies the second minor side 104. A second flange limb 122 extends transverse of the third opposed limb 116 and is slidably received in the second elongated slot 107. With this construction, the second ground shield substantially completely surrounds the second elongated contact 66 received in the second passage 58.

It was earlier explained that the first and second ground shields 78, 80 both include a first integral downwardly projecting ground contact 84 for engagement with a mating ground contact or pad 86 of an external unit such the motherboard 26. As earlier noted, the mating ground contact or pad 86 is associated with the mating contacts 22 engaged by the first contact surfaces 64, 68 of the first and second elongated contacts 62, 66. Also, each of the first and second ground shields 78, 80 includes a second integral ground contact 88 for engagement with an associated ground contact surface 90 on the planar card 28 inserted into the card receiving slot 60.

As particularly well seen in FIGS. 1 and 10, both of the second integral ground contacts 88 of the first and second ground shields 78, 80 project into the card receiving recess 60, with the ground contact 88 of the first ground shield 78 generally facing the ground contact 88 of the second ground shield 80. Further, each of the second integral ground contacts 88 of the first and second ground shields project into the card receiving recess 60 at a location nearer the top wall 46 of the outer frame 36 than either of the second contact surfaces 72, 74 of the first and second elongated contacts 62, 66. In this manner, an early mate, late break, grounding operation can be established. More specifically, this construction serves to establish in a preemptive manner common electrical grounding across the contact interface in advance of other electrical interconnection of the first and second electrical contacts 62, 66.

Figure 12:
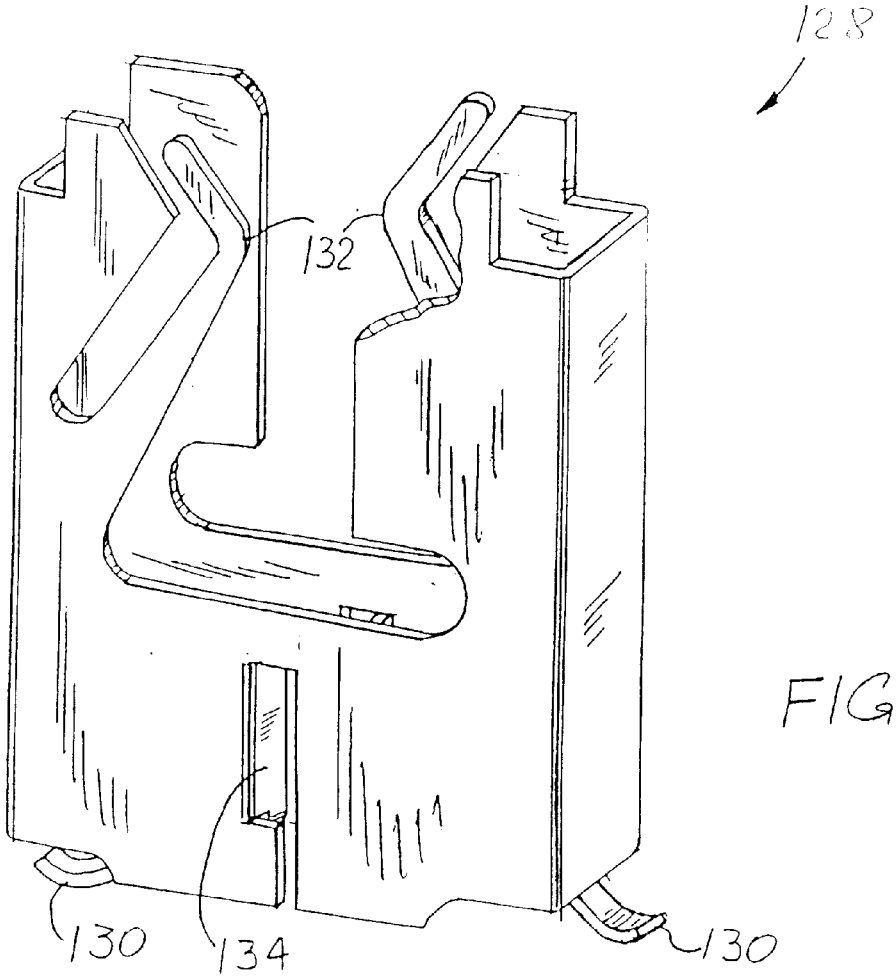
FIG. 12 is a perspective view illustrating a single tubular ground shield which is another embodiment of the pair of opposed ground shields illustrated in FIG. 9.
Figure 13:
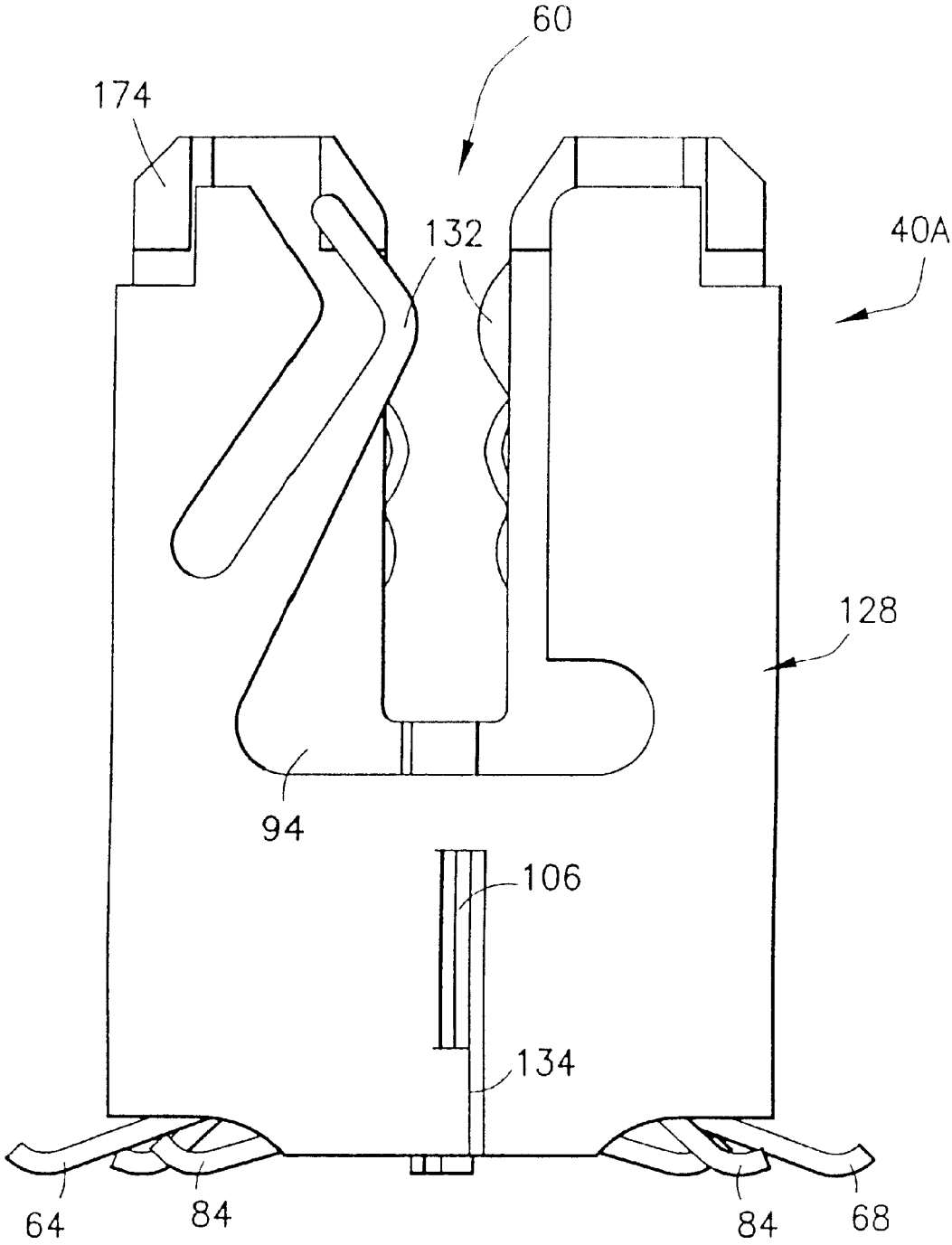
FIG. 13 is side elevation view of a modified chiclet module which includes the single tubular ground shield illustrated in FIG. 12.

Turn now to FIGS. 12 and 13 for a description of another embodiment of the invention. In this instance, in place of the pair of opposed ground shields 78, 80 enveloping the insulative housing 54, a single tubular ground shield 128 is slidably received on the insulative housing in proximate engagement with the outer peripheral surface 82. As with the combined pair of C-shaped ground shields 78, 80, the tubular ground shield 128 includes a first pair of integral ground contacts 130, each provided for engagement with a ground contact 86 (FIG. 1) of an external unit or motherboard 26 associated with the mating contacts engaged by the first contact surfaces of the first and second elongated contacts 62, 66.

The tubular ground shield 128 also includes a second pair of integral ground contacts 132 for engagement with the ground contact surfaces 90 (see FIG. 1) on the planar card 28 inserted into the card receiving slot 70 of the insulative housing 54. In every way, the tubular ground shield 128 operates in the manner of the pair of opposed ground shields 78, 80. This includes the provision of a pair of flange limbs 134, similar to the flange limbs 122, which are mutually opposed and coplanar and are slidably received in the second elongated slots 106, 107 of the insulative housing 54. With this construction, the ground shield 128 substantially completely surrounds each of the elongated contacts 62, 66 received in the passages 56, 58.

Figure 6:
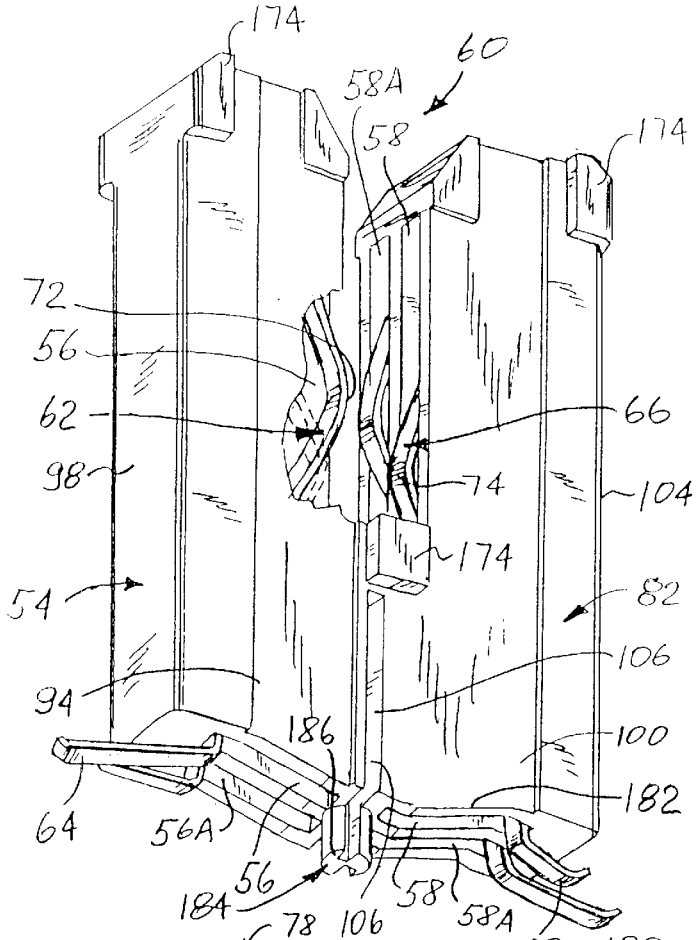
FIG. 6 is a perspective view of an insulative housing for a chiclet module with elongated contacts in place.
Figure 7:
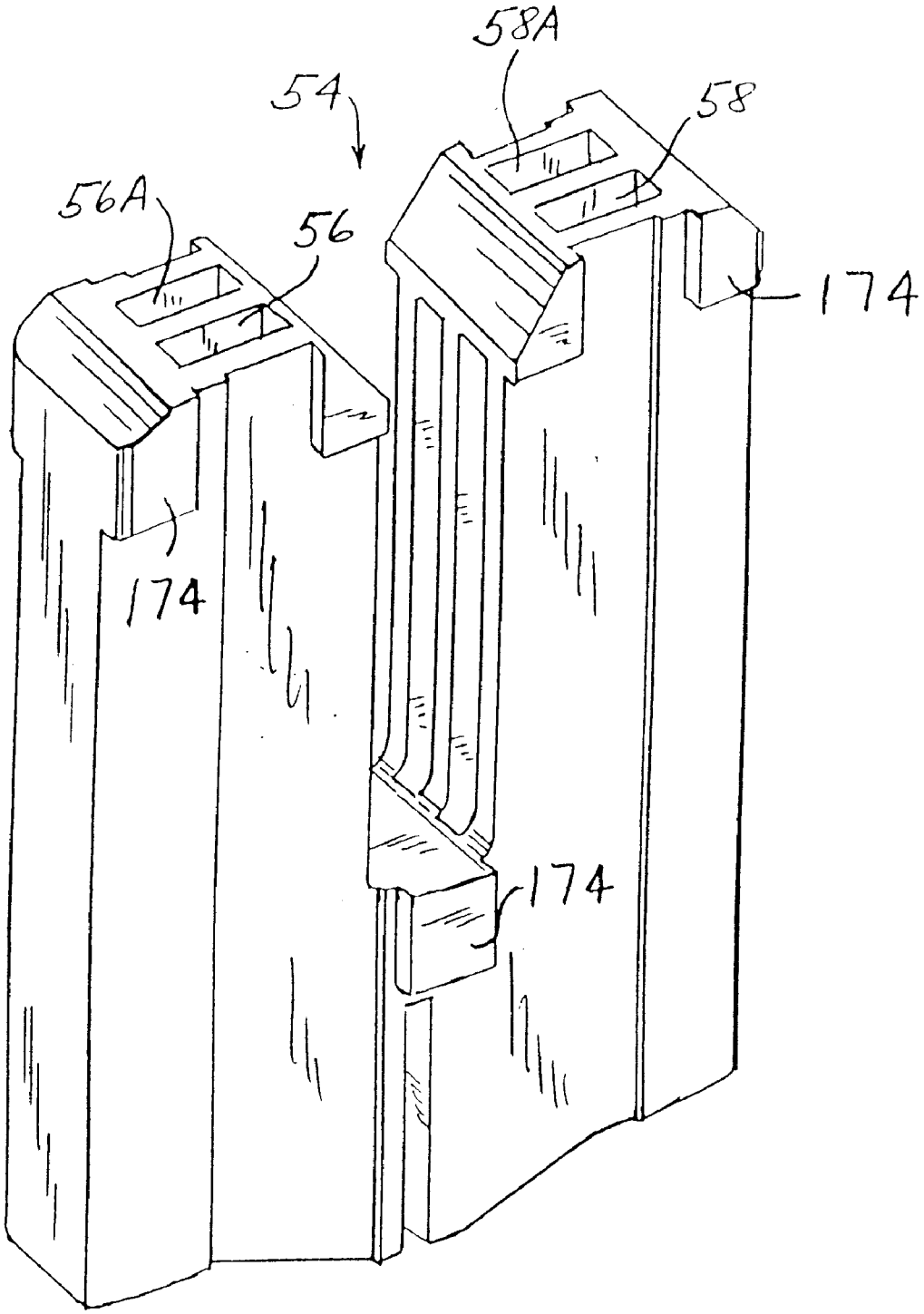
FIG. 7 is another perspective view of the insulative housing for a chiclet module but without elongated contacts being illustrated.
Figure 8A:
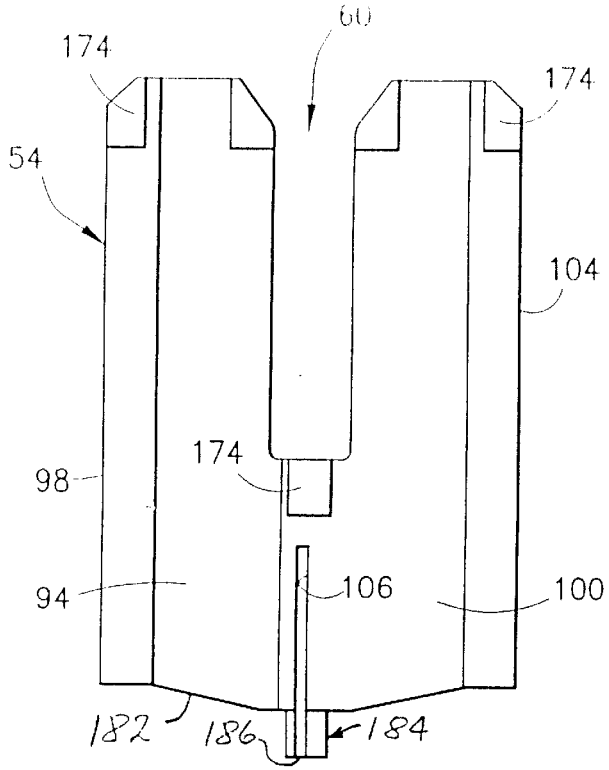
FIG. 8A is a front elevation view of the insulative housing illustrated in FIGS. 6 and 7.
Figure 8B:
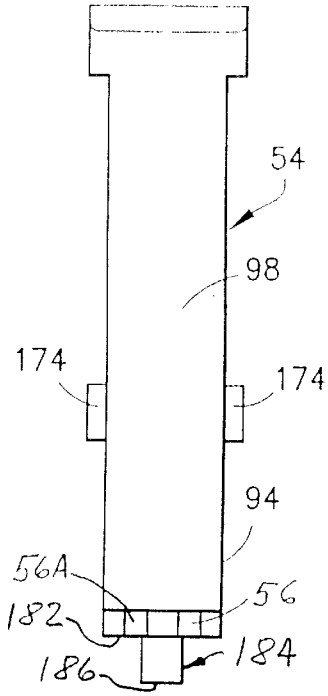
FIG. 8B is a side elevation view of the insulative housing illustrated in FIGS. 6, 7, and 8A.
Figure 8C:
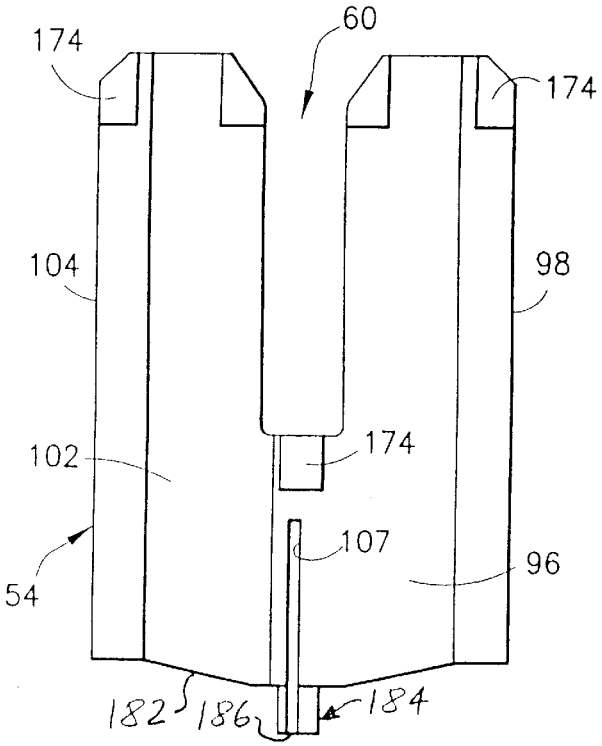
FIG. 8C is a rear elevation view of the insulative housing illustrated in FIGS. 6, 7, 8A, and 8B.
Figure 8D:
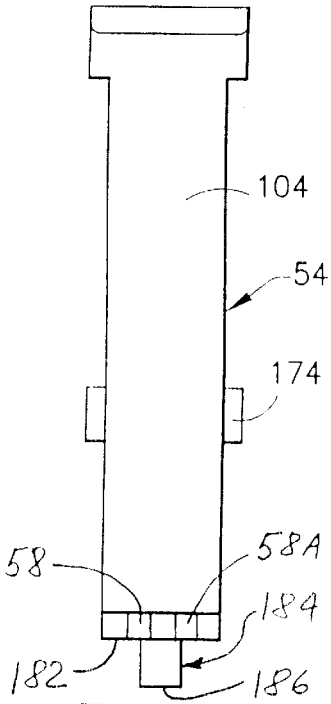
FIG. 8D is a side elevation view, taken opposite that of FIG. 8B of the insulative housing illustrated in FIGS. 6, 7, 8A, 8B, and 8C.

In a preferred construction, again viewing FIGS. 6 and 7, the insulative housing 54 is formed with first and second spaced pairs of generally parallel elongated passages therein 56 and 56A and 58 and 58A with an elongated contact firmly received in each in the manner previously described. As previously, each elongated contact has first and second contact surfaces with the construction previously described for mating contact with associated contact surfaces on the motherboard 26 and on the planar card 28.

Figure 14:
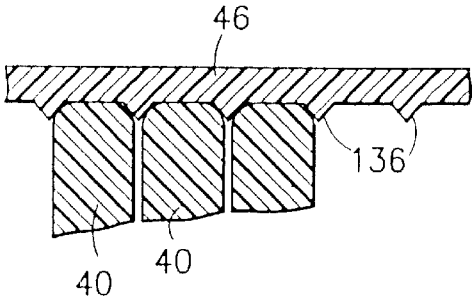
FIG. 14 is a detail view in section illustrating a portion of the outer frame provided with a variety of locating features at a plurality of longitudinally spaced locations for positioning the chiclet modules at defined spaced locations within the outer frame.
Figure 15:
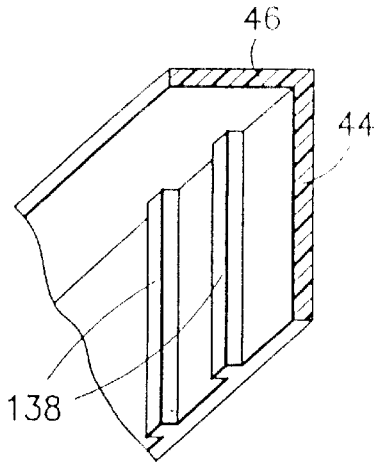
FIGS. 15, 16, 17, 18, are detail section views, similar to FIG. 14, illustrating variations of the construction of FIG. 14, each illustrating a portion of the outer frame provided with a variety of different locating features at a plurality of longitudinally spaced locations, also for positioning the chiclet modules at defined spaced locations within the outer frame.
Figure 16:
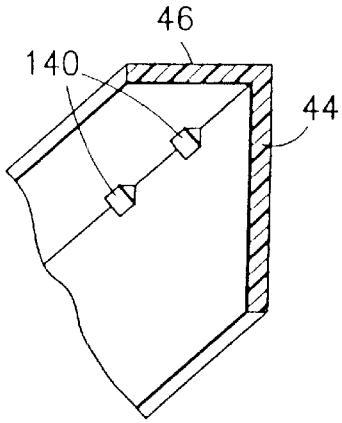

In order to hold the chiclet modules at defined spaced locations within the outer frame 36, the outer frame may be provided with a variety of locating features at a plurality of longitudinally spaced locations. In FIG. 14, for example, the top wall 46 is provided with a plurality of laterally extending protrusions 136 projecting into the reception region 38 which engage associated chiclet modules 40 and maintain them in a spaced side-by-side relationship. In this instance, the spacing between each pair of protrusions is approximately equal to the thickness of a chiclet module and adjacent chiclet modules are maintained a slight distance apart. Similar constructions are illustrated in FIGS. 15 and 16. In FIG. 15, a plurality of similarly spaced upright protrusions 138 are provided on the inside surfaces of the side walls 44. In FIG. 16, a plurality of similarly spaced corner protrusions 140 are provided at the inner interface between the side walls 44 and top wall 46. In each instance, the protrusions 136 or 138 or 140 repeat at the same pitch distances for the entire length of the outer frame 36.

Figure 17:
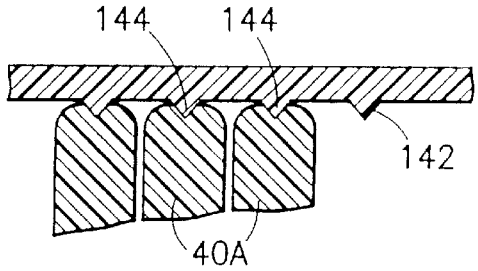
Figure 18:
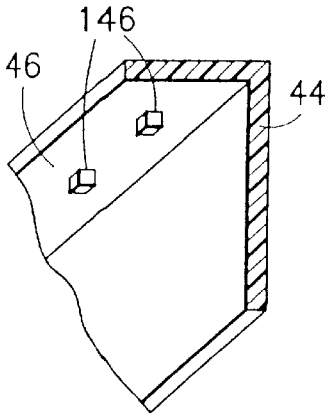

In other instances illustrated in FIGS. 17 and 18, each chiclet module has complimentary locating features formed for engagement with locating features of the outer frame, again, such that each chiclet module is positively positioned with respect to the outer frame. In FIG. 17, for instance, lateral protrusions 142 are illustrated which may be of the nature and longitudinal spacing of the protrusions 136. In this instance, modified chiclet modules 40A have a laterally extending groove 144 which matingly receives the lateral protrusions 142 to maintain the chiclet modules in a spaced side-by-side relationship with adjacent chiclet modules maintained a slight distance apart. In FIG. 18, downwardly extending protrusions 146 are appropriately located to project into the uppermost end portions of the elongated passages 56, 56A, 58, and 58A of the insulative housing 54. This construction is also seen, for example, in FIG. 2. In the same manner as in the previously described embodiments, in this instance, the chiclet modules are maintained in a spaced side-by-side relationship with adjacent chiclet modules maintained a slight distance apart.

Figure 2:
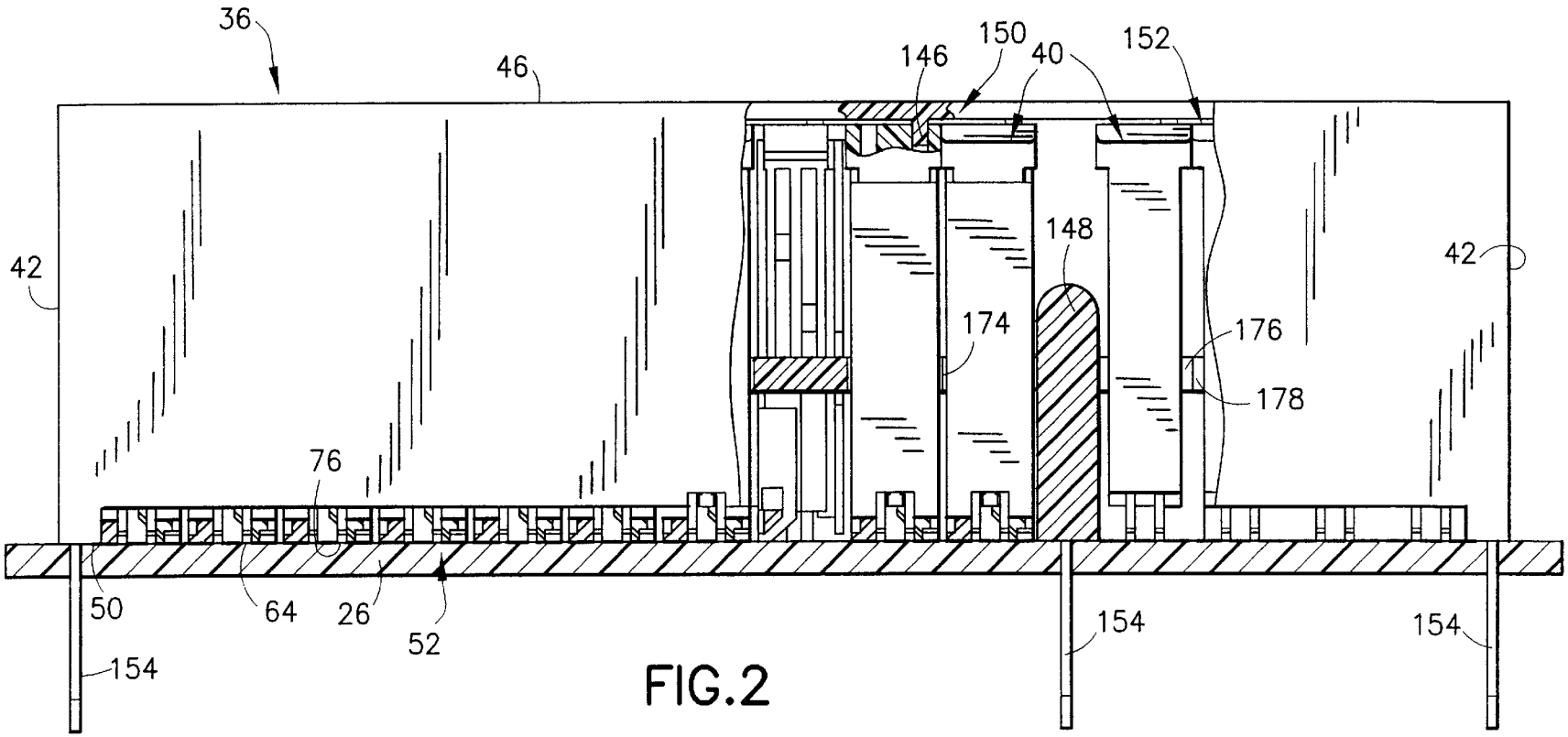
FIG. 2 is a side elevation view of the card edge connector assembly illustrated in FIG. 1, certain parts being cut away and shown in section.
Figure 3:
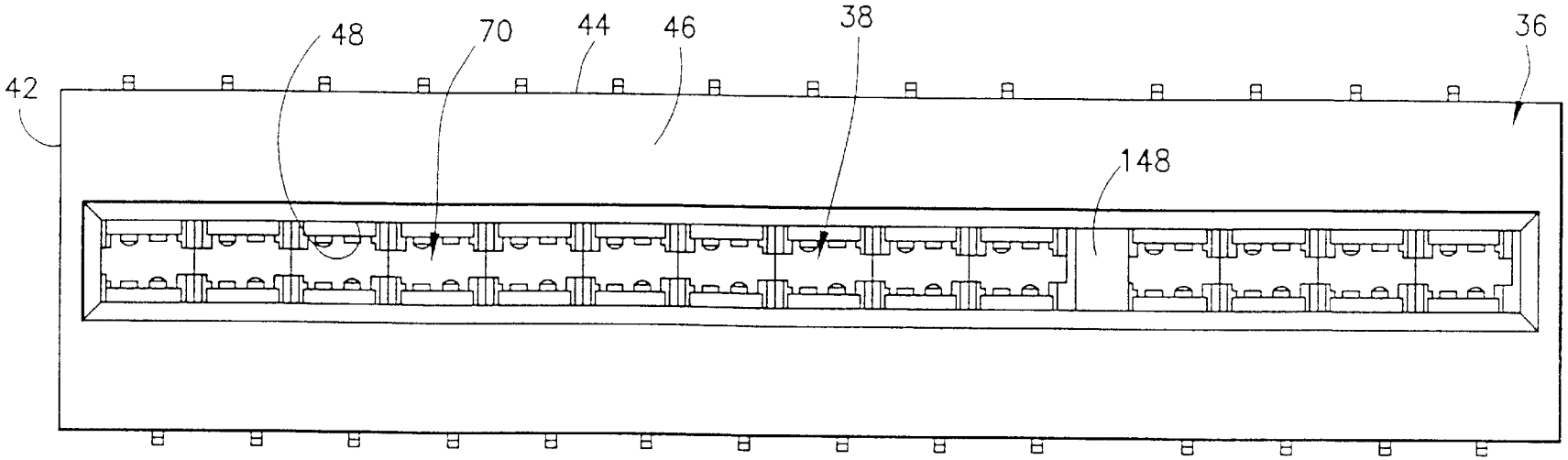
FIG. 3 is a top plan view of the card edge connector assembly illustrated in FIGS. 1 and 2.
Figure 4:
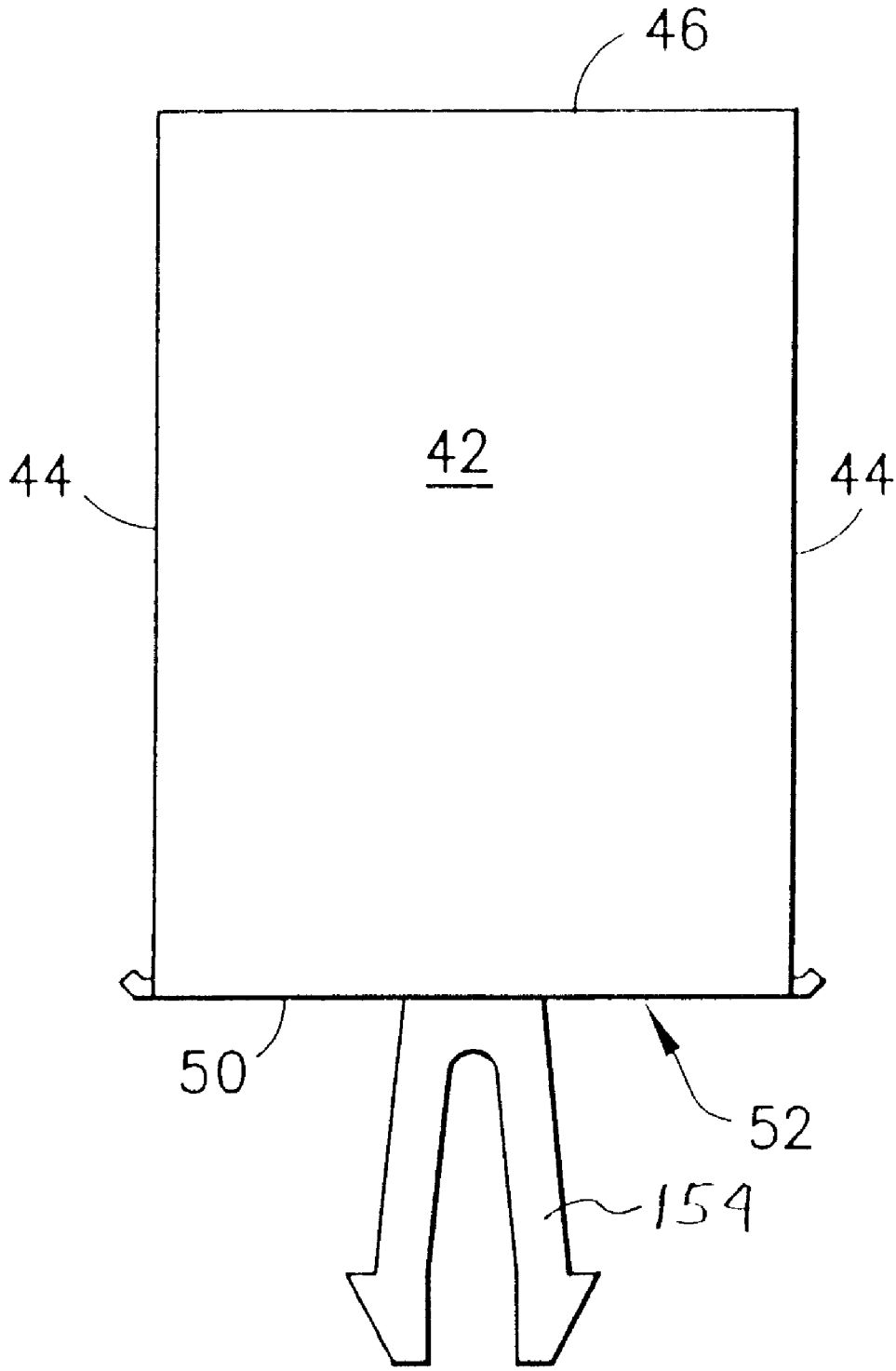
FIG. 4 is an end elevation view of the card edge connector assembly illustrated in FIGS. 1, 2, and 3.
Figure 5:
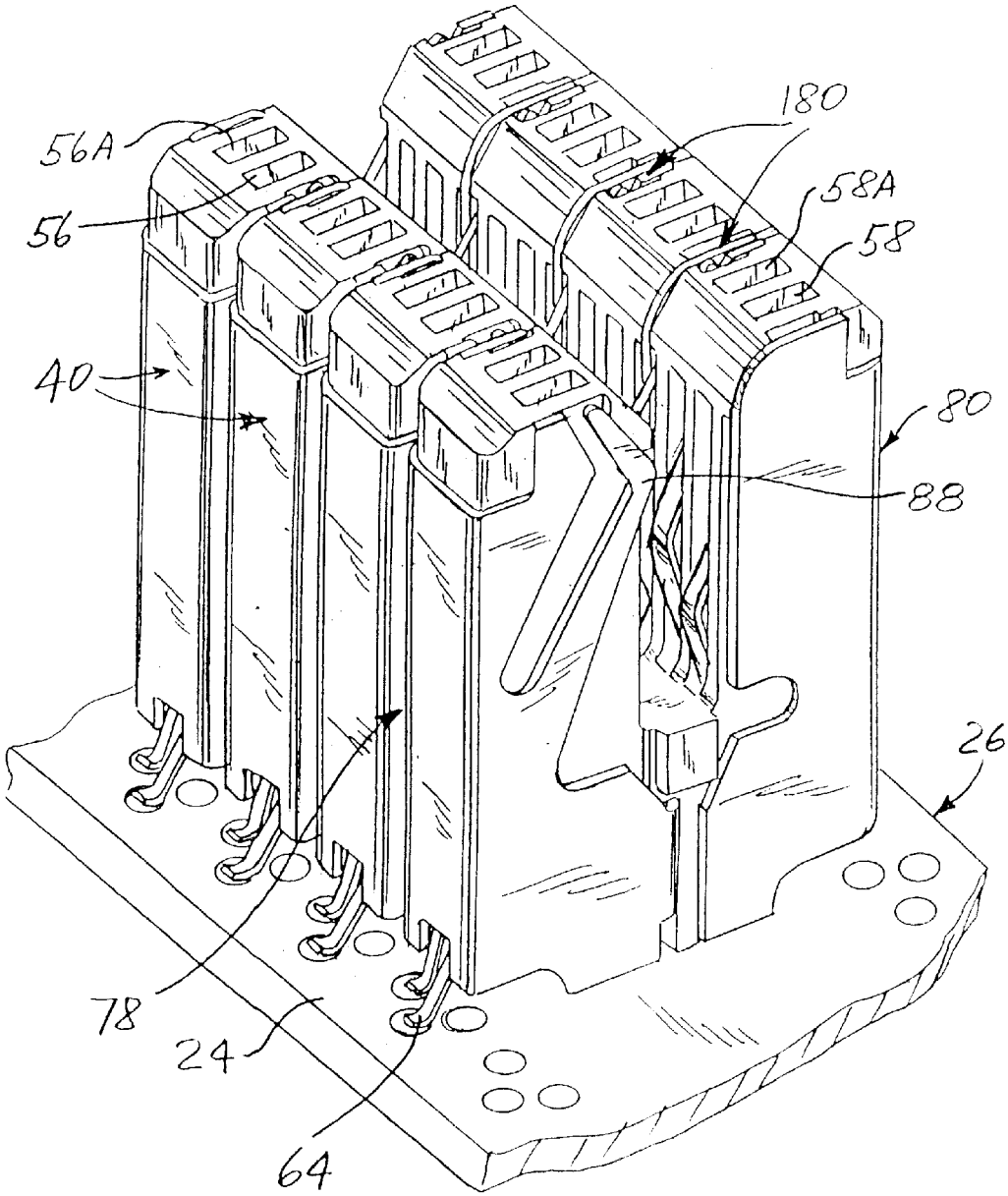
FIG. 5 is a perspective view of a grouping of chiclet modules according to the invention positioned on a motherboard but absent the outer frame which normally envelops the chiclet modules.

As seen in FIGS. 1, 2, and 3, a septum member 148 may be provided intermediate the spaced end walls 42 and lying in a plane parallel to the end walls. With this construction, the reception region 38 is separated into first and second chambers 150, 152 (FIG. 2) for receiving the chiclet modules 40. A retention clip 154 may be attached to the septum member 148 at the lower rim, extending away from the outer frame 36 in a direction away from the top wall 46.

Indeed, a plurality of retention clips 154 may be provided for attaching the outer frame 36 to an underlying surface, for example, to the motherboard 26, one of the retention clips mounted on each end wall 42 and on each septum member 148 at the lower rim 50. In each instance, the retention clip extends in a direction away from the top wall 46 and are secured to the substrate with known techniques.

Figure 19:
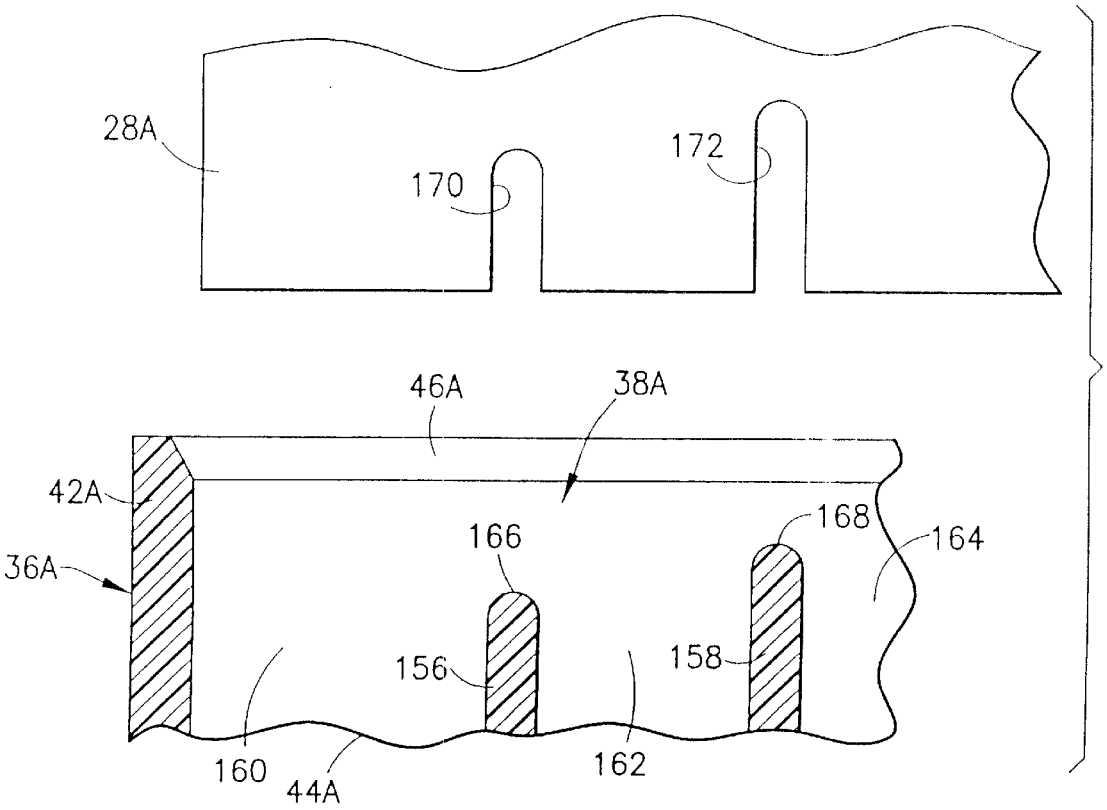
FIG. 19 is a detail exploded view in elevation illustrating a modified outer frame in which a pair of longitudinally spaced septum members are provided, each with a registration feature enabling a suitably formed planar card with conductive contact members to be fully inserted into the card receiving slot of the card edge connector assembly.

In FIG. 19, a modified outer frame 36A is illustrated in which a pair of longitudinally spaced septum members 156, 158 are provided intermediate the spaced end walls 42A. The septum members 156, 158 lie in planes parallel to the end walls 42A and thereby separate the reception region 38A into a plurality of chambers 160, 162, 164 for receiving the chiclet modules 40. Each of the septum members 156, 158 includes a registration feature, for example, uppermost edges 166, 168 enabling a modified planar card 28A with conductive contact members thereon (not shown) and complementary registration features 170, 172 to be fully inserted through the longitudinally extending aperture of the top wall 46A and into the card receiving slot. When this occurs, the slotted registration features 170, 172 are positioned and sized for engageable reception, first of the uppermost edges 166, 168, respectively, then the remainder of the septum members 156, 158 so that, in turn, the conductive contact members on the planar card 28A can be mechanically and electrically engaged by the second elongated contact surfaces of the elongated contacts 62, 66 of the plurality of chiclet modules.

Of course, the corollary is true, that if the planar card 28A does not possess the registration features 170, 172 positioned and sized to receive the septum members 156, 158, the planar card would be rejected and incapable of use with the system of the invention.

When the chiclet modules 40 are arranged in side-by-side fashion within the outer frame 36, it may be desirable to provide some further instrumentality, other than those already described, to keep adjacent chiclet modules at spaced distances apart. This can be achieved, for example, by providing at least one boss member 174, and preferably several at spaced apart locations on the outer peripheral surface 82 of one insulative housing 54 of a chiclet module 40 such that it is, or they are, engageable with the insulative housing of an adjoining chiclet module. See FIG. 2. The boss member would be dimensioned to prevent mutual engagement of the ground shield 128 or ground shields 78, 80 of the adjoining chiclet modules.

In an alternative construction, a plurality of mutually opposed pairs of boss members 176, 178 (FIGS. 2 and 11) may be provided on the insulative housings of adjoining chiclet modules. In this instance, the mutually opposed pairs of boss members are aligned for engagement and dimensioned to prevent mutual engagement of the ground shields of the adjoining chiclet modules.

Recognizing that there are instances in which it is desirable for the ground shields of adjoining chiclet modules to be electrically in common, a bridging contact 180 (FIGS. 5 and 9) may be provided on at least one of the ground shields of one of the chiclet members 40 engageable with the ground shield of its adjoining chiclet member.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

an outer frame having a top wall with a card edge receiving aperture through the top wall; and a plurality of modules positioned inside the outer frame, the modules being orientated in an adjacent lateral side-by-side configuration relative to each other along an elongate length of the outer frame, each module comprising a housing, an electrical signal contact connected to the housing, and a ground shield connected to the housing, wherein the housings of the modules combine to form a card edge receiving area inside the outer frame, wherein the card edge receiving area is aligned beneath the card edge receiving aperture and is adapted to receive an edge of a printed circuit board, and wherein ground contact arms of the ground shields and contact arms of the electrical signal contacts extend into the card edge receiving area.

2. An electrical connector comprising:

an outer frame having a top wall with a card edge receiving aperture through the top wall; and a plurality of modules positioned inside the outer frame, the modules being orientated in an adjacent side-by-side configuration, each module comprising a housing, an electrical signal contact connected to the housing, and a ground shield member connected to the housing, wherein the housings of the modules combine to form a card edge receiving area inside the outer frame, wherein the card edge receiving area is aligned beneath the card edge receiving aperture and is adapted to receive an edge of a printed circuit board, wherein the electrical signal contacts extend into the card edge receiving area, and wherein the ground shield members are located between sides of the housings of adjacent modules and located between the housings and the outer frame.

* * * * *